United States Patent [19]

Libit

[11] Patent Number: 4,489,509

[45] Date of Patent: Dec. 25, 1984

[54] OVERSHOE

[76] Inventor: Sidney M. Libit, 441 Lakeside Ter., Glencoe, Ill. 60022

[21] Appl. No.: 536,696

[22] Filed: Sep. 28, 1983

[51] Int. Cl.[3] ..... A43B 3/16; A43B 3/18

[52] U.S. Cl. ..... 36/7.1 R; 36/7.3; 36/50; D2/271

[58] Field of Search ..... 36/7.1 R, 7.1 A, 7.3, 36/8.1, 45, 50, 105, 4, 9 R, 9 A, 10, 7.2, 7.5, 7.6, 7.8; D2/271, 272, 275, 281

[56] References Cited

U.S. PATENT DOCUMENTS

| | | | |
|---|---|---|---|
| 480,097 | 8/1892 | Horovitz | 36/50 |
| 3,535,800 | 10/1970 | Stohr | 36/45 |
| 3,634,954 | 1/1972 | Larsen et al. | 36/7.3 |
| 3,737,723 | 6/1973 | Kanor | 36/7.3 |
| 4,169,324 | 10/1979 | Gibbs | 36/10 |

FOREIGN PATENT DOCUMENTS

| | | | |
|---|---|---|---|
| 75627 | 10/1946 | Czechoslovakia | 36/50 |
| 1313972 | 4/1902 | France | 36/50 |

*Primary Examiner*—Henry S. Jaudon
*Assistant Examiner*—Steven N. Meyers
*Attorney, Agent, or Firm*—Hill, Van Santen, Steadman & Simpson

[57] ABSTRACT

A step-in type overshoe composed of a molded plastic material which in its relaxed condition has a plurality of accordion-type pleats formed therein with their fold lines being generally horizontal. The overshoe has a flexible instep area arranged to be deformed upon receiving the toe of a shoe, together with a latching means for releasably compressing the rear end of the accordion-type pleats to permit seating of the shoe within the overshoe whereupon disengagement of the latching means returns the accordion-type pleats to their relaxed state embracing the foot of the wearer.

10 Claims, 11 Drawing Figures

OVERSHOE

BACKGROUND OF THE INVENTION

1. Field of the Invention

The present invention is in the field of overshoes which can be put on easily over conventional shoes, and including a molded plastic material having accordion-type pleats and a flexible instep area which permit the wearer to insert the shoe completely into the overshoe without difficulty.

2. Description of the Prior Art

The design of overshoes for wearing during inclement weather has always been met with difficult problems. The overshoe must fit tight enough so that it conforms to the shoe but at the same time it cannot be so tightly fitting that it is difficult to put on. This is particularly true in the case of elderly or infirm people who find it difficult to pull an overshoe over existing shoes when such action requires severe bending of the torso and strong pulling of the overshoe against the friction provided at the sliding surfaces between the overshoe and the regular shoe.

There have been some patent disclosures dealing with flexible overshoes, particularly in the field of disposable overshoes. For example, Hardman U.S. Pat. No. ,652,637 described an overshoe which was adapted to be rolled up and carried in the purse or pocket and consisted of an integral thin structure of flexible homogeneous plastic having a foot portion and an ankle portion. The foot portion was provided with a flat sole, a relatively short toe, and a heel portion. The sole, heel and toe portions were designed to be of increased thickness.

In U.S. Pat. No. 3,283,422 issued to Nygard, there is described a construction for disposable overshoes composed of sheet material which when unfolded loosely fit around the regular shoe.

U.S. Pat. No. 3,634,954 to Larsen et al describes a disposable overshoe of a heat shrink film which is storable in a flat condition, being generally symmetrical about its major axis.

In U.S. Pat. No. 3,737,723 to Kanor there was described another disposable overshoe employing a single flat sheet of flexible heat shrinkable material which was center-folded to form a pair of complementary halves having a straight bottom edge adjacent the centerfold and a top edge. The mating edges were heat sealed together at the back edge, at the front edge, and adjacent the bottom edge.

SUMMARY OF THE INVENTION

The present invention provides an improved flexible step-in type overshoe which makes it easier for the user to step into the overshoe with his regular shoes. The overshoe of the present invention includes a molded plastic material which is molded such that in its relaxed condition it has a plurality of accordion-type pleats formed therein with their fold lines being generally horizontal. These pleats extend from one side of the instep area around the back of the shoe, to the other side of the instep area. Coupled with the accordion-type pleats there is a flexible instep area arranged to be deformed upon receiving the toe of a shoe. This instep area may also include additional accordion-type pleats with their fold lines at an acute angle relative to the generally horizontal fold lines of the first-mentioned accordion-type pleats. Latching means are provided which releasably compress the rear end of the accordion-type pleats at the back of the shoe to permit seating of the shoe within the overshoe. Upon release of the latching means, the molded plastic assumes its relaxed condition where it is in snugly fitting relationship with the shoe and protects the shoe as well as the portions of the wearer's leg adjacent the ankle from rain, snow, and the like.

The latching means may include a slotted strap which extends from the horizontally extending accordion-type pleats, cooperating with a lug on the back of the overshoe onto which the strap can be releasably locked. Optionally, it may consist of a molded hook or a strap which extends underneath the heel. Other features of the present invention include a pair of unpraised spaced wings in generally parallel spaced relationship in the instep area of the overshoe to provide the flexibility required in the instep area. In a further embodiment, an improved overshoe of the present invention may include a shaft portion which extends above the accordion-type pleats and has additional accordion-type pleats having their fold lines generally vertical.

BRIEF DESCRIPTION OF THE DRAWINGS

A further description of the present invention will be made in conjunction with the attached sheets of drawings which illustrate several embodiments of the invention.

DESCRIPTION OF THE PREFERRED EMBODIMENTS

Figure 1:
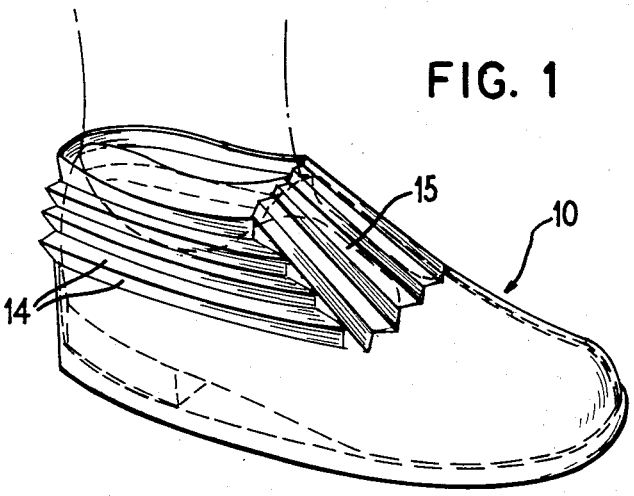
FIG. 1 is a view in perspective of an improved overshoe construction according to the present invention.

In FIG. 1, reference numeral 10 indicates generally a step-in type overshoe of the present invention which is of molded construction and of pleated configuration. The material for the overshoe must be stiff enough to maintain its molded configuration in its relaxed state, but flexible enough to be deformed without being limp. Suitable materials include vinyl polymers such as polyvinyl chloride or copolymers of polyvinyl chloride and polyvinyl acetate. Another suitable rubber-like elastomer is an acrylonitrilebutadiene-styrene copolymer (ABS). The invention is shown applied to a low-cut shoe in FIGS. 1 to 5. This overshoe 10 includes a base portion 11, a heel portion 12, and an instep portion 13. In accordance with the present invention, the sides and the back of the shoe are molded to provide accordion-type pleats 14 having their fold lines generally horizontal as best seen in FIG. 2. The accordion-type pleats 14 extend from one end of the instep area 13 around the back of the shoe and the heel portion 12, to the opposite side of the flexible instep area 13.

Figure 2A:
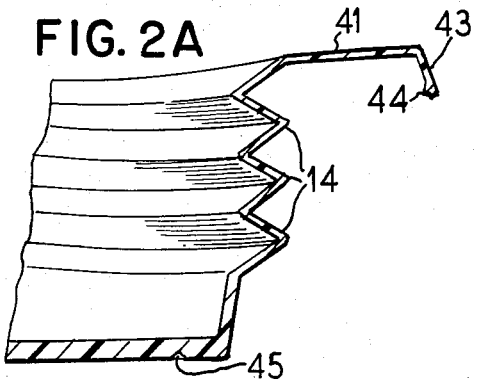
FIGS. 2A and 2B are fragmentary views of another type of latching means.
Figure 2:
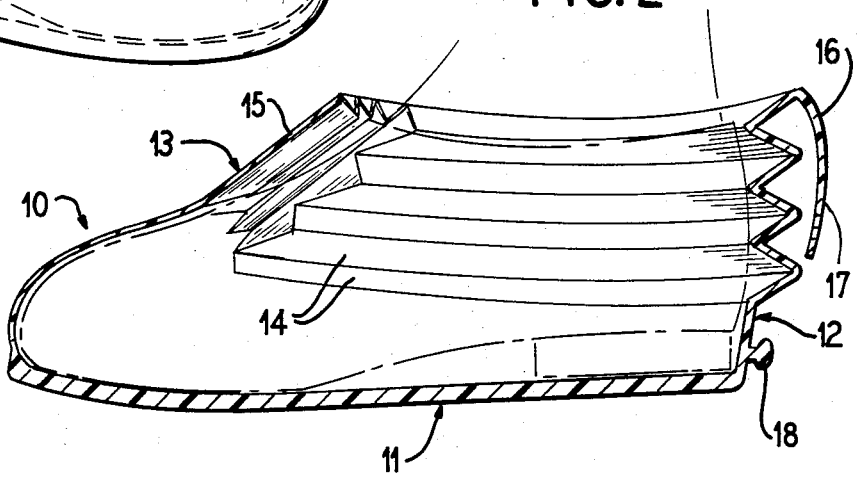
FIG. 2 is a cross-sectional view of the overshoe construction shown in FIG. 1 in its relaxed condition.
Figure 3:
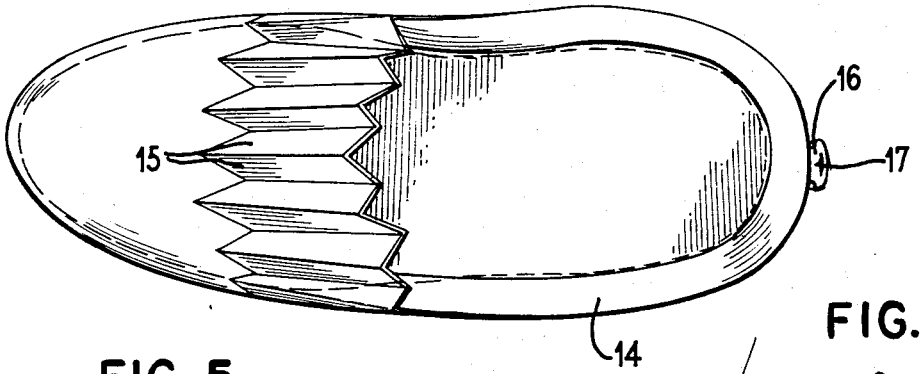
FIG. 3 is a plan view of the overshoe construction shown in FIGS. 1–2.

The instep area 13 in the form of the invention shown in FIGS. 1 to 3 also includes accordion pleats 15 whose fold lines extend at an acute angle to the fold lines of the main accordion pleats 14. The presence of the accordion pleats 15 in the instep area give the instep area flexibility so that when the street shoe S as shown in FIG. 4 is placed into the overshoe, there is enough resiliency by virtue of the accordion pleats 15 to yield and accommodate some displacement as the shoe S is being placed inside the overshoe.

A strap 16 depends from the upper end of the accordion pleated structure. It includes a slot 17 which is arranged to fit over an anchor such as a lug 18 located above the base of the shoe as illustrated in FIG. 2. When the toe of the conventional shoe S is being slipped into the overshoe, the strap 16 keeps the back end of the accordion pleats compressed as illustrated in FIG. 4 so that the heel of the conventional shoe can be readily accommodated at the heel portion of the overshoe. Then, after the toe and heel of the conventional shoe S are snugly received inside the overshoe, the strap 17 is simply disengaged from the lug 18 permitting the overshoe to return to its normal relaxed form shown in FIG. 2 with the overshoe completely covering the conventional shoe S and protecting the same against rain and snow as well as providing a temperature barrier.

Figure 2B:
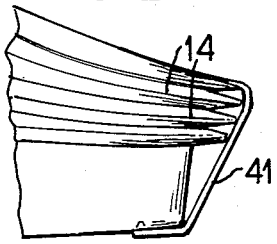

The latch means shown in FIG. 2A includes simply a hook 43 integrally molded onto the top of the boot. The hook 43 is arranged to fit under the heel of the overshoe as shown in FIG. 2B, using complementary serrations 44 and 45 on the heel and hook, if necessary, to hold the hook against the heel. In this form, merely scuffing the heel of the overshoe against the floor is effective to release the engagement of the hook and permit the overshoe to achieve its extended position.

Figure 4:
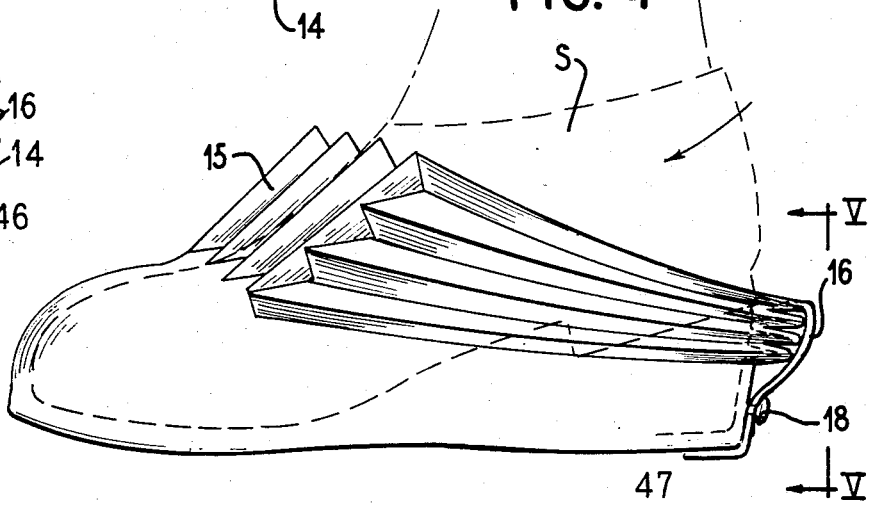
FIG. 4 is a view illustrating a modified overshoe as a street shoe is being inserted into the toe thereof and prior to release of the accordion-type pleats.
Figure 5:
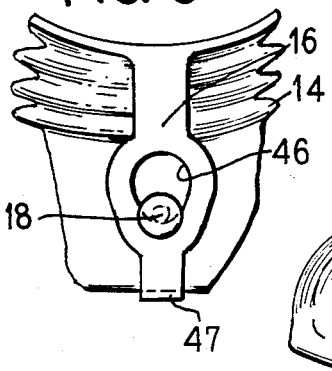
FIG. 5 is a view taken substantially along the line V—V.

In the form shown in FIGS. 4 and 5, the latching means includes a strap 16 having an elongated keyhole type aperture 46 formed therein and a bent end portion 47 arranged to be received against the heel portion at the sole of the overshoe. Sliding or scuffing movement of the end portion against the floor is effective to release the strap from the lug 18, thereby allowing the pleats to rise to their extended position.

Figure 6:
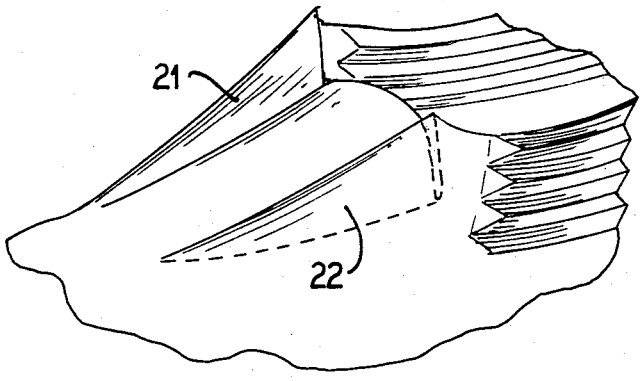
FIG. 6 is a fragmentary view in perspective of a modified form of the present invention including a different type of instep area.

Flexibility in the instep area can also be achieved by the structure shown in FIG. 6 of the drawings. In this form of the invention, the instep area is provided with a pair of upstanding flexible hollow wings 21 and 22 of generally triangular cross section. When the shoe is put into the instep area, the wings provide enough flexibility to accommodate movement between the street shoe and the overshoe until such time as the heel is seated in the overshoe.

Figure 7:
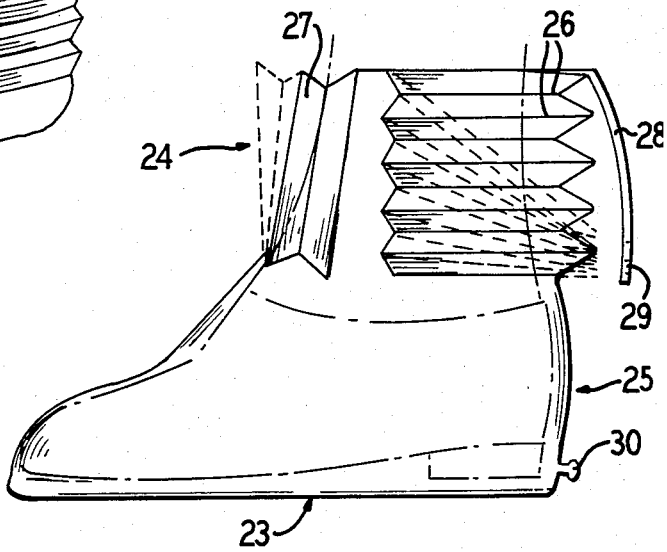
FIG. 7 is a view illustrating a form of overshoe which is intermediate in height, the view illustrating the condition of the shoe in both its folded and expanded condition.
Figure 8:
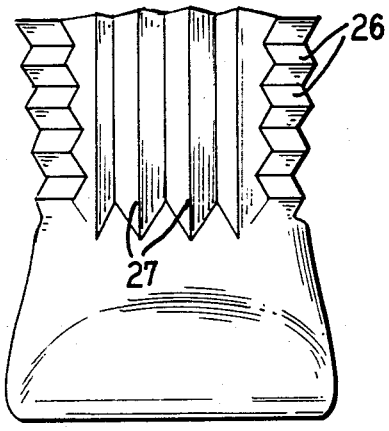
FIG. 8 is a front elevational view of the type of structure shown in FIG. 7.

A slightly higher type shoe is illustrated in FIGS. 7 and 8 of the drawings. This type of shoe is arranged to provide some protection for the ankle of the wearer and above. The overshoe includes a base portion 23, an instep portion 24 and a heel portion 25. Accordion pleats 26 having their fold lines generally horizontal provide an expansible upper section for the overshoe. The instep area also includes accordion pleats 27 as best seen in FIG. 8 to provide the flexibility necessary in that area. The dashed lines in FIG. 7 illustrate the folded condition of the accordion pleats, while the solid lines indicate the relaxed or extended position of the pleats. A strap 28 provided with a slot 29 is arranged to engage a lug 30 at the bottom of the overshoe as in a previous embodiment.

Figure 9:
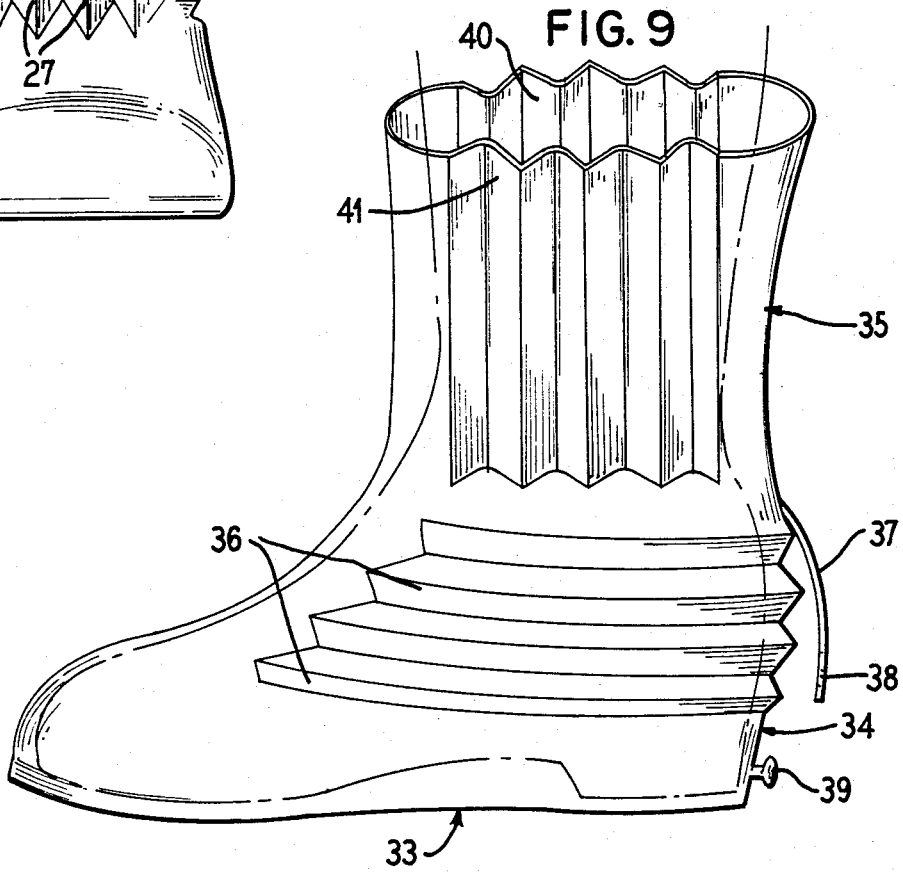
FIG. 9 illustrates still another form of the invention utilizing vertically extending accordion pleats in the upper portion of the overshoe.

In FIG. 9 there is shown another embodiment of the invention, the overshoe shown in this Figure including a base portion 33, a heel portion 34, and a shaft portion 35 extending up to the area of the wearer's ankle. Accordion-type pleats 36 having their fold lines substantially horizontal are provided in the lower portion of the shoe, and a strap 37 having a slot 38 is arranged to be received over a lug 39 as in the previously described embodiments.

In the structure of FIG. 9, two sets of accordion pleats 40 and 41 with their fold lines generally vertical are provided on opposite sides of the shaft portion 35. The inner edges of the pleats may be rounded, if desired, to provide a more comfortable fit against the user's leg. The instep area of the overshoe is made inherently flexible by a suitable choice of materials. The overshoe of FIG. 9 is shown in its relaxed or free state, with the accordion-type pleats 36 holding the overshoe open for accommodating entry by the user's shoe.

From the foregoing it will be understood that the improved overshoe of the present invention provides a slip-on capability for applying overshoes over street shoes, making it easier for aged or infirm people to use the overshoe without outside assistance.

It should be evident that various modifications can be made to the described embodiments without departing from the scope of the present invention.

I claim as my invention:

1. A step-in type overshoe composed of a molded plastic material, said overshoe in its relaxed condition having a plurality of accordion-type pleats formed therein with their fold lines being generally horizontal, said overshoe having a flexible instep area arranged to be deformed upon receiving the toe of a shoe, and latching means releasably compressing the rear end of said accordion-type pleats to permit seating of said shoe within said overshoe.

2. An overshoe according to claim 1 wherein said flexible instep area includes additional accordion-type pleats with their fold lines at an acute angle relative to the generally horizontal fold lines of the other accordion-type pleats.

3. An overshoe according to claim 2 wherein said additional accordion-type pleats extend across the instep area of said overshoe and connect both ends of the other accordion-type pleats.

4. An overshoe according to claim 1 in which said latching means includes a slotted strap extending from said accordion-type pleats.

5. An overshoe according to claim 4 which includes an anchoring lug at the back of said overshoe onto which said strap is arranged to be releasably locked.

6. An overshoe according to claim 1 which includes a pair of upraised, spaced wings in generally parallel spaced relation in the instep area of said overshoe providing said flexible instep area.

7. An overshoe according to claim 1 in which said accordion-type pleats in their relaxed condition extend to the ankle area of the wearer.

8. An overshoe according to claim 1 which includes a shaft portion extending above said accordion-type pleats, said shaft portion having additional accordion-type pleats having their fold lines extending in a generally vertical direction.

9. An overshoe according to claim 1 in which said molded plastic is a vinyl polymer.

10. An overshoe according to claim 1 in which said molded plastic is an acrylonitrile-butadiene-styrene copolymer.

* * * * *